US009328689B2

(12) United States Patent
Dölker

(10) Patent No.: US 9,328,689 B2
(45) Date of Patent: May 3, 2016

(54) METHOD FOR THE OPEN-LOOP CONTROL AND CLOSED-LOOP CONTROL OF AN INTERNAL COMBUSTION ENGINE

(75) Inventor: Armin Dölker, Friedrichshafen (DE)

(73) Assignee: MTU FRIEDRICHSHAFEN GMBH, Friedrichshaffen (DE)

( * ) Notice: Subject to any disclaimer, the term of this patent is extended or adjusted under 35 U.S.C. 154(b) by 768 days.

(21) Appl. No.: 13/503,570

(22) PCT Filed: Oct. 19, 2010

(86) PCT No.: PCT/EP2010/006381

§ 371 (c)(1),
(2), (4) Date: Jul. 5, 2012

(87) PCT Pub. No.: WO2011/047832

PCT Pub. Date: Apr. 28, 2011

(65) Prior Publication Data

US 2012/0265424 A1 Oct. 18, 2012

(30) Foreign Application Priority Data

Oct. 23, 2009 (DE) ..... 10 2009 050 467

(51) Int. Cl.
*F02D 41/38* (2006.01)
*F02D 41/22* (2006.01)
(Continued)

(52) U.S. Cl.
CPC ..... *F02D 41/3863* (2013.01); *F02D 41/222* (2013.01); *F02D 41/3854* (2013.01);
(Continued)

(58) Field of Classification Search
CPC ... F02M 55/025; F02M 69/465; F02M 69/54; F02M 37/0029; F02M 59/366; F02M 63/0225; F02M 37/0023; F02M 37/0052; F02M 37/106; F02M 25/0809; F02M 25/08; F02M 1/00; F02M 2700/4311; F02M 59/34; F02M 63/025; F02B 1/00; F02D 41/0002; F02D 2041/001; F02D 41/2467; F02D 41/0025; F02D 2250/31; F02D 41/40; F02D 41/402; F02D 41/1497; F02D 2041/224; F02D 41/221; F02D 41/3863
USPC ..... 701/103, 104
See application file for complete search history.

(56) References Cited

U.S. PATENT DOCUMENTS 5,937,826 A 8/1999 Olson et al.
5,941,214 A 8/1999 Hoffmann et al.
(Continued)

FOREIGN PATENT DOCUMENTS

DE 19618932 Y 11/1997
DE 10155247 B4 8/1998
(Continued)

*Primary Examiner* — Hung Q Nguyen
*Assistant Examiner* — Brian P Monahon
(74) *Attorney, Agent, or Firm* — Lucas & Mercanti, LLP; Klaus P. Stoffel

(57) ABSTRACT

The invention relates to a method for the open-loop control and the closed-loop control of an internal combustion engine (1), the rail pressure (pCR) being controlled in the normal operating state in a closed loop control mode via an intake throttle (4) on the lower pressure side as the first pressure control member in a rail pressure control loop and at the same time a rail pressure disturbance variable being applied to the rail pressure (pCR) via a pressure control valve (12) on the high pressure side as the second pressure control member. For this purpose, a pressure control valve volume flow (VDRV) is redirected from the rail (6) to a fuel tank (2) via the pressure control valve (12) on the high pressure side, and an emergency operation mode is activated once a defective rail pressure sensor (9) is detected, in which emergency operation the pressure control valve (12) on the high pressure side and the intake throttle (4) on the low pressure side are actuated depending on the same set point value.

8 Claims, 9 Drawing Sheets

(51) Int. Cl.

| | |
|---|---|
| ***F02D 41/02*** | (2006.01) |
| ***F02M 63/02*** | (2006.01) |
| ***F02D 41/14*** | (2006.01) |
| ***F02D 41/20*** | (2006.01) |

(52) U.S. Cl.

CPC ..... *F02M63/025* (2013.01); *F02D 41/1401* (2013.01); *F02D 2041/1411* (2013.01); *F02D 2041/2027* (2013.01); *F02D 2041/223* (2013.01); *F02D 2041/227* (2013.01); *F02D 2250/31* (2013.01)

(56) References Cited

U.S. PATENT DOCUMENTS

| | | | | |
|---|---|---|---|---|
| 6,053,147 | A | 4/2000 | Hemmerlein et al. | |
| 6,234,148 | B1 * | 5/2001 | Hartke et al. | 123/447 |
| 6,293,253 | B1 | 9/2001 | Arnold et al. | |
| 6,578,553 | B1 * | 6/2003 | Schubert et al. | 123/458 |
| 6,712,047 | B2 | 3/2004 | Rueger | |
| 6,948,480 | B2 * | 9/2005 | Eser et al. | 123/495 |
| 7,010,415 | B2 | 3/2006 | Dölker | |
| 7,017,549 | B2 | 3/2006 | Dölker | |
| 7,240,667 | B2 | 7/2007 | Dölker | |
| 7,451,038 | B2 | 11/2008 | Kosiedowski et al. | |
| 7,779,816 | B2 | 8/2010 | Dölker | |
| 2004/0249555 | A1 * | 12/2004 | Doelker | F02D 41/222 701/107 |
| 2006/0054149 | A1 * | 3/2006 | Uchiyama | 123/676 |
| 2008/0092852 | A1 * | 4/2008 | Bucher et al. | 123/457 |
| 2009/0082943 | A1 * | 3/2009 | Sugiyama et al. | 701/103 |
| 2009/0082946 | A1 * | 3/2009 | Ishizuka et al. | 701/106 |
| 2009/0326788 | A1 * | 12/2009 | Yuasa et al. | 701/104 |
| 2010/0269794 | A1 | 10/2010 | Li et al. | |
| 2011/0016959 | A1 | 1/2011 | Hermes et al. | |

FOREIGN PATENT DOCUMENTS

| | | | |
|---|---|---|---|
| DE | 19800760 | Y | 8/1998 |
| DE | 19731201 | | 1/1999 |
| DE | 19731995 | A1 | 1/1999 |
| DE | 19757594 | A1 | 7/1999 |
| DE | 19916100 | | 10/2000 |
| DE | 10003298 | | 8/2001 |
| DE | 10014737 | | 10/2001 |
| DE | 10330466 | | 10/2004 |
| DE | 102004061474 | A1 | 6/2006 |
| DE | 19612412 | B4 | 7/2006 |
| DE | 102005029138 | Y | 12/2006 |
| DE | 102006009068 | A1 | 8/2007 |
| DE | 102006040441 | B3 | 2/2008 |
| DE | 102007059352 | Y | 6/2009 |
| DE | 102008000983 | Y | 10/2009 |
| DE | 102009031527 | | 11/2010 |
| EP | 0899442 | | 3/1999 |
| EP | 1826385 | | 8/2007 |
| GB | 2327777 | A | 8/1999 |
| WO | 03046357 | A | 6/2003 |

* cited by examiner

METHOD FOR THE OPEN-LOOP CONTROL AND CLOSED-LOOP CONTROL OF AN INTERNAL COMBUSTION ENGINE

The present application is a 371 of International application PCT/EP2010/006381, filed Oct. 19, 2010, which claims priority of DE 10 2009 050 467.2, filed Oct. 23, 2009, the priority of these applications is hereby claimed and these applications are incorporated herein by reference.

BACKGROUND OF THE INVENTION

The invention concerns a method for the open-loop and closed-loop control of an internal combustion engine, in which, during normal operation, the rail pressure is automatically controlled in a closed-loop rail pressure control system by a suction throttle on the low-pressure side as a first pressure regulator, and, at the same time, the rail pressure is acted upon with a rail pressure disturbance variable by means of a pressure control valve on the high-pressure side as a second pressure regulator by virtue of the fact that a pressure control valve volume flow is redirected from the rail into a fuel tank by the pressure control valve on the high-pressure side.

In an internal combustion engine with a common rail system, the quality of combustion is critically determined by the pressure level in the rail. Therefore, in order to stay within legally prescribed emission limits, the rail pressure is automatically controlled. A closed-loop rail pressure control system typically comprises a comparison point for determining a control deviation, a pressure controller for computing a control signal, the controlled system, and a software filter in the feedback path for computing the actual rail pressure from the raw values of the rail pressure. The control deviation is computed as the difference between a set rail pressure and the actual rail pressure. The controlled system comprises the pressure regulator, the rail, and the injectors for injecting the fuel into the combustion chambers of the internal combustion engine. For example, DE 103 30 466 B3 describes a common rail system of this type, in which the pressure controller acts on a suction throttle by means of a control signal. The suction throttle in turn sets the admission cross section to the high-pressure pump and thus the volume of fuel delivered.

The unprepublished application DE 10 2009 031 527.6 also describes a common rail system with automatic control of the rail pressure by means of a suction throttle on the low-pressure side as a first pressure regulator. This automatic pressure control in the common rail system is supplemented by a pressure control valve on the high-pressure side as a second pressure regulator, by which a pressure control valve volume flow is redirected from the rail into the fuel tank. A constant leakage of, for example, 2 liters/minute is reproduced in the low-load range by means of activation of the pressure control valve. Under normal operating conditions, on the other hand, no fuel is redirected from the rail. The pressure control valve volume flow is determined on the basis of a set volume flow with a static and a dynamic component. In the computation of the dynamic component and the computation of the control signal for the closed-loop rail pressure control system, the actual rail pressure is a critical input variable. Therefore, a defective rail pressure sensor or an error in the signal acquisition of the rail pressure results in a false actual rail pressure and causes faulty activation of both the suction throttle as the first pressure regulator and the pressure control valve as the second pressure regulator. The cited document fails to provide any fault safeguard in the event of failure of the rail pressure sensor.

SUMMARY OF THE INVENTION

Therefore, the objective of the invention is to design a common rail system with more reliable automatic rail pressure control by means of a suction throttle on the low-pressure side as a first pressure regulator and a pressure control valve on the high-pressure side as a second pressure regulator.

If a defective rail pressure sensor has been detected, then a change is made to emergency operating mode, in which the pressure control valve on the high-pressure side and the suction throttle on the low-pressure side are actuated as a function of the same setpoint value. The setpoint value in turn corresponds to a set emergency operation volume flow, which is computed by an emergency operation input-output map as a function of a set injection quantity and the engine speed. The central procedure of the method of the invention thus consists in three steps following the failure of the rail pressure sensor. In the first step, a switch is made to the emergency operation input-output map to compute the set emergency operation volume flow; in the second step, the pressure controller is deactivated; and in the third step, the set emergency operation volume flow is set as the critical correcting variable of the closed-loop rail pressure control system and is the critical set value for the pressure control valve. The emergency operation input-output map is realized in such a form that in the entire operating range of the internal combustion engine, a pressure control valve volume flow is redirected from the rail into the fuel tank.

In practice, the case can arise that after a failure of the rail pressure sensor, the rail pressure rises. The reason for this is a high-pressure pump, which pumps at the upper tolerance limit, i.e., it pumps more. However, since the pressure control valve at a constant setpoint value redirects a greater pressure control valve volume flow into the tank with increasing rail pressure, the pressure rise in the rail is counteracted. Thus, by virtue of the fact that the same setpoint value is used for both the pressure control valve and the closed-loop rail pressure control system in the emergency operating mode, the operating reliability is decisively improved. Although a deviation between the actual rail pressure and the set rail pressure develops in the emergency operating mode, in actual practice this deviation is very small, typically less than 50 bars at a set rail pressure of 2,400 bars. The small deviation allows high engine output even in emergency operating mode. Another positive effect of the small pressure difference is that emissions in emergency operating mode differ only slightly from emissions during normal operation.

In addition, it is provided that in emergency operating mode, a leakage volume flow is superimposed on the set emergency operation volume flow as a correcting variable of the closed-loop rail pressure control system. The leakage volume flow is computed as a function of the set injection quantity and the engine speed. More precise adjustment is realized by the leakage input-output map.

DETAILED DESCRIPTION OF THE INVENTION

Figure 1:
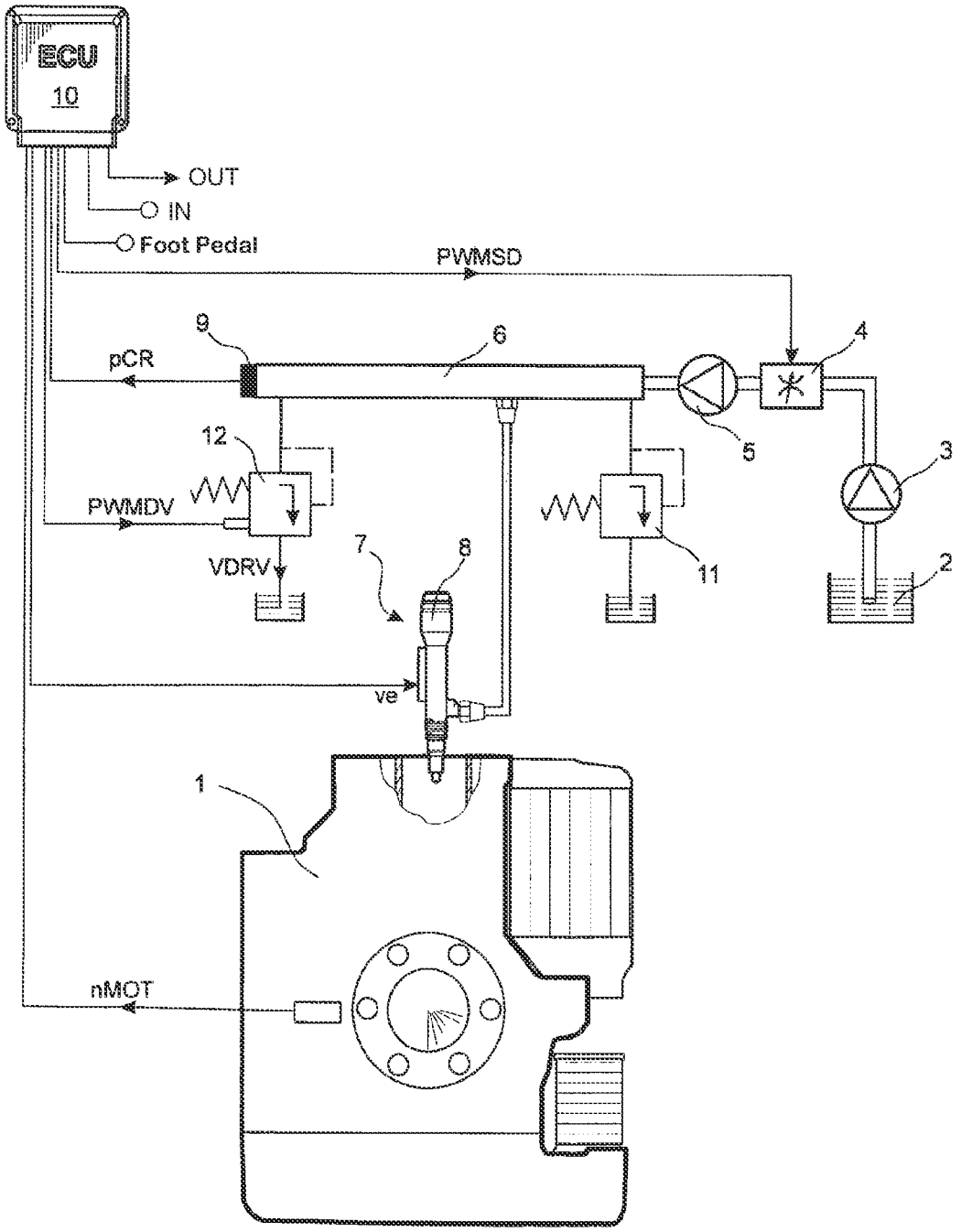
FIG. 1 is a system diagram.

FIG. 1 shows a system diagram of an electronically controlled internal combustion engine 1 with a common rail system. The common rail system comprises the following mechanical components: a low-pressure pump 3 for pumping fuel from a fuel tank 2, a variable suction throttle 4 on the low-pressure side for controlling the fuel volume flow flowing through the lines, a high-pressure pump 5 for pumping the fuel at increased pressure, a rail 6 for storing the fuel, and injectors 7 for injecting the fuel into the combustion chambers of the internal combustion engine 1. Optionally, the common rail system can also be realized with individual accumulators, in which case an individual accumulator 8 is integrated, for example, in the injector 7 as an additional buffer volume. To protect against an impermissibly high pressure level in the rail 6, a passive pressure control valve 11 is provided, which, in its open state, redirects the fuel from the rail 6 into the fuel tank 2. An electrically controllable pressure control valve 12 also connects the rail 6 with the fuel tank 2. The position of the pressure control valve 12 defines a fuel volume flow which is redirected from the rail 6 into the fuel tank 2 and which thus represents a rail pressure disturbance variable. In the remainder of the text, this fuel volume flow is denoted by the pressure control valve volume flow VDRV.

The operating mode of the internal combustion engine 1 is determined by an electronic control unit (ECU) 10. The electronic control unit 10 contains the usual components of a microcomputer system, for example, a microprocessor, interface adapters, buffers and memory components (EEPROM, RAM). Operating characteristics that are relevant to the operation of the internal combustion engine 1 are applied in the memory components in the form of input-output maps/characteristic curves. The electronic control unit 10 uses these to compute the output variables from the input variables. FIG. 1 shows the following input variables as examples: the rail pressure pCR, which is measured by means of a rail pressure sensor 9, an engine speed nMOT, a signal FP, which represents an engine power output desired by the operator, and an input variable IN, which represents additional sensor signals, for example, the charge air pressure of an exhaust gas turbocharger.

FIG. 1 also shows the following as output variables of the electronic control unit 10: a PWM signal PWMSD for controlling the suction throttle 4 as the first pressure regulator, a signal view for controlling the injectors 7 (injection start/injection end), a PWM signal PWMDV for controlling the pressure control valve 12 as the second pressure regulator, and an output variable OUT. The PWM signal PWMDV defines the position of the pressure control valve 12 and thus the pressure control valve volume flow VDRV. The output variable OUT is representative of additional control signals for the open-loop and closed-loop control of the internal combustion engine 1, for example, a control signal for activating a second exhaust gas turbocharger during a register supercharging.

Figure 2:
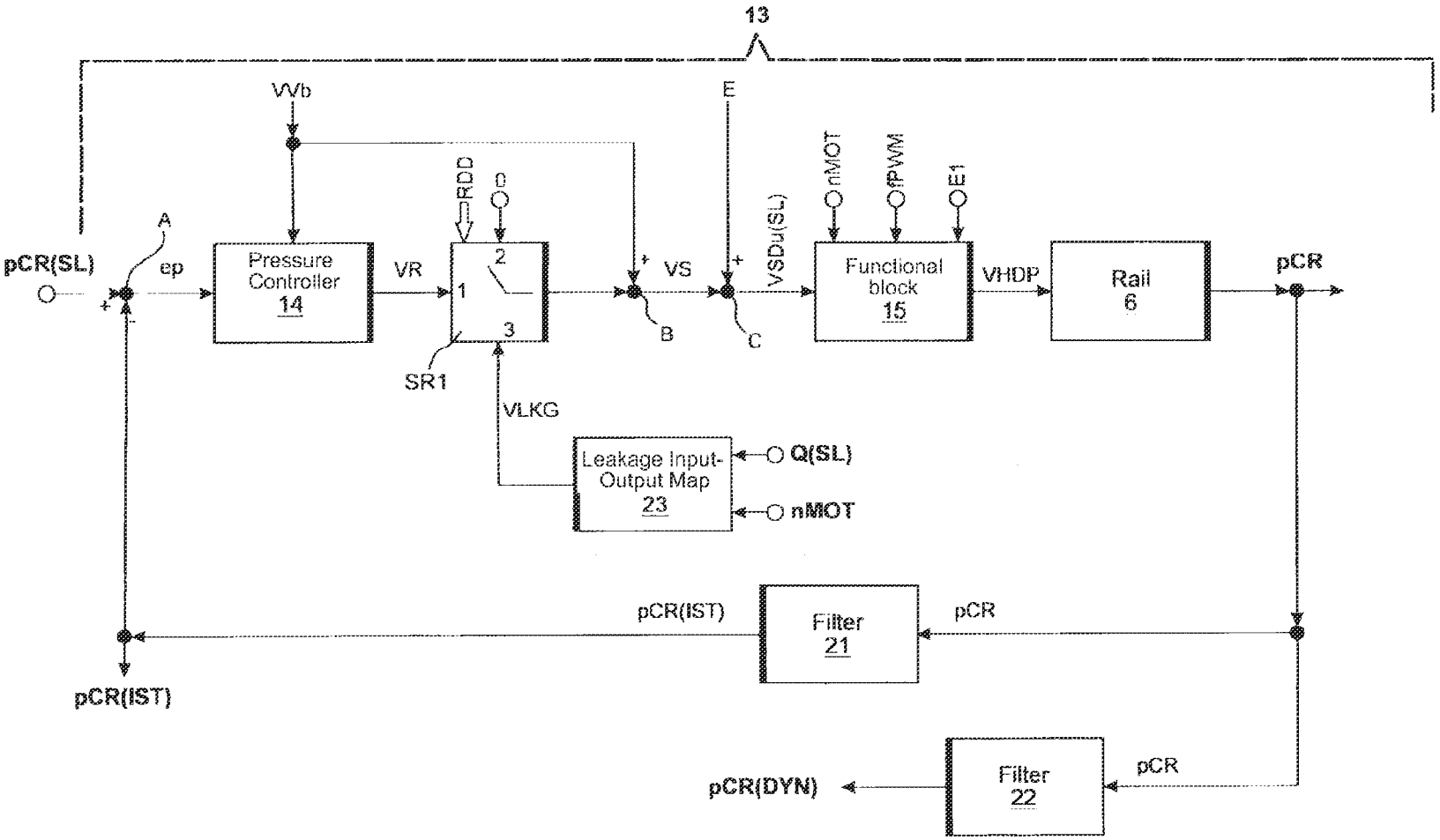
FIG. 2 is a closed-loop rail pressure control system.

FIG. 2 shows a closed-loop rail pressure control system 13 for the closed-loop control of the rail pressure pCR. The input variables of the closed-loop rail pressure control system 13 are: a set rail pressure pCR(SL), a set consumption VVb, a signal RDD, a variable E, the engine speed nMOT, the PWM base frequency fPWM, and a variable E1. The variable E has the value zero during normal operation, whereas in emergency operating mode the variable E corresponds to the set emergency operation volume flow VNB(SL). The variable E1 combines, for example, the battery voltage and the ohmic resistance of the suction throttle coil with lead-in wire, which enter into the computation of the PWM signal. The signal RDD is set when a defective rail pressure sensor is detected. The output variables of the closed-loop rail pressure control system 13 are the raw value of the rail pressure pCR, an actual rail pressure pCR(IST), and a dynamic rail pressure pCR (DYN). The actual rail pressure pCR(IST) and the dynamic rail pressure pCR(DYN) are further processed in the open-loop control system shown in FIG. 4.

Figure 3:
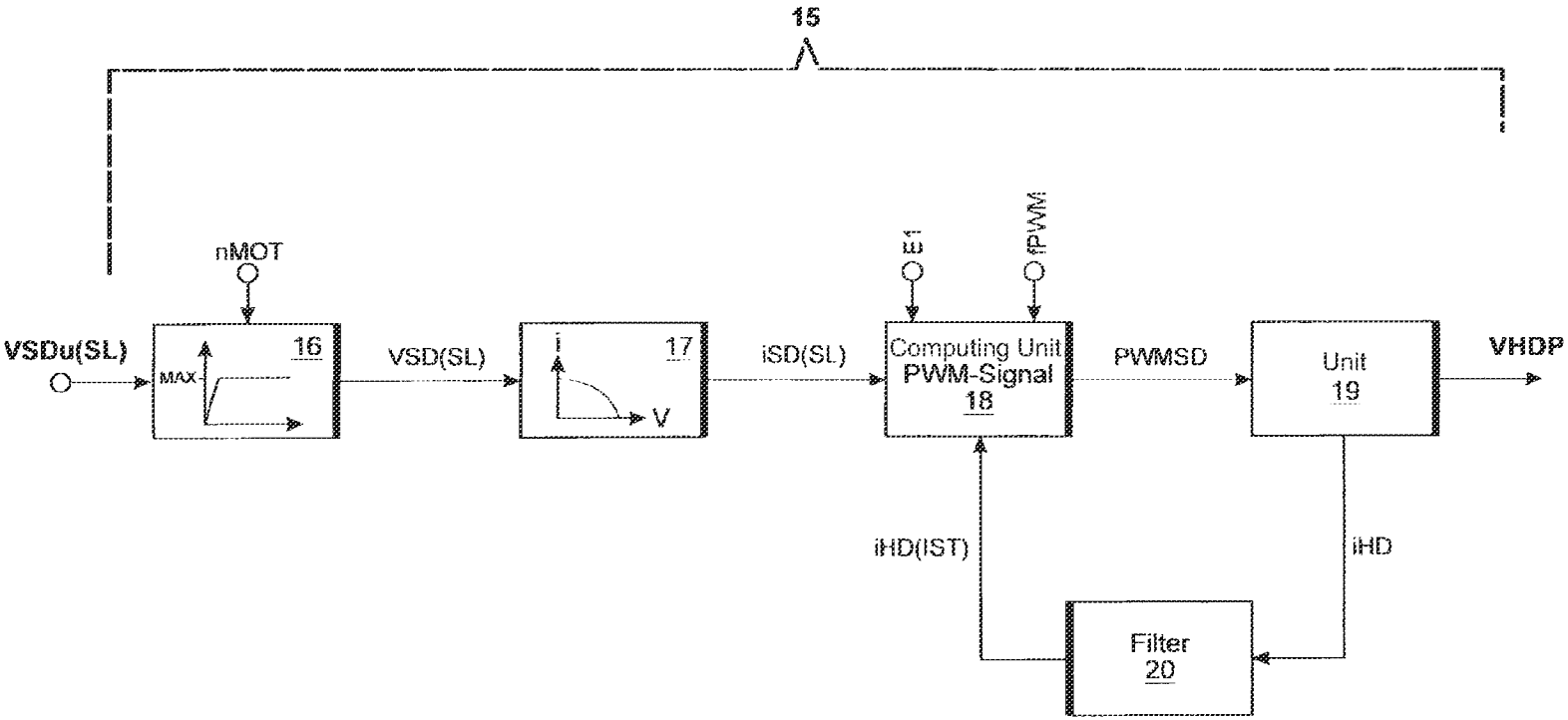
FIG. 3 is a functional block of the closed-loop rail pressure control system.
Figure 4:
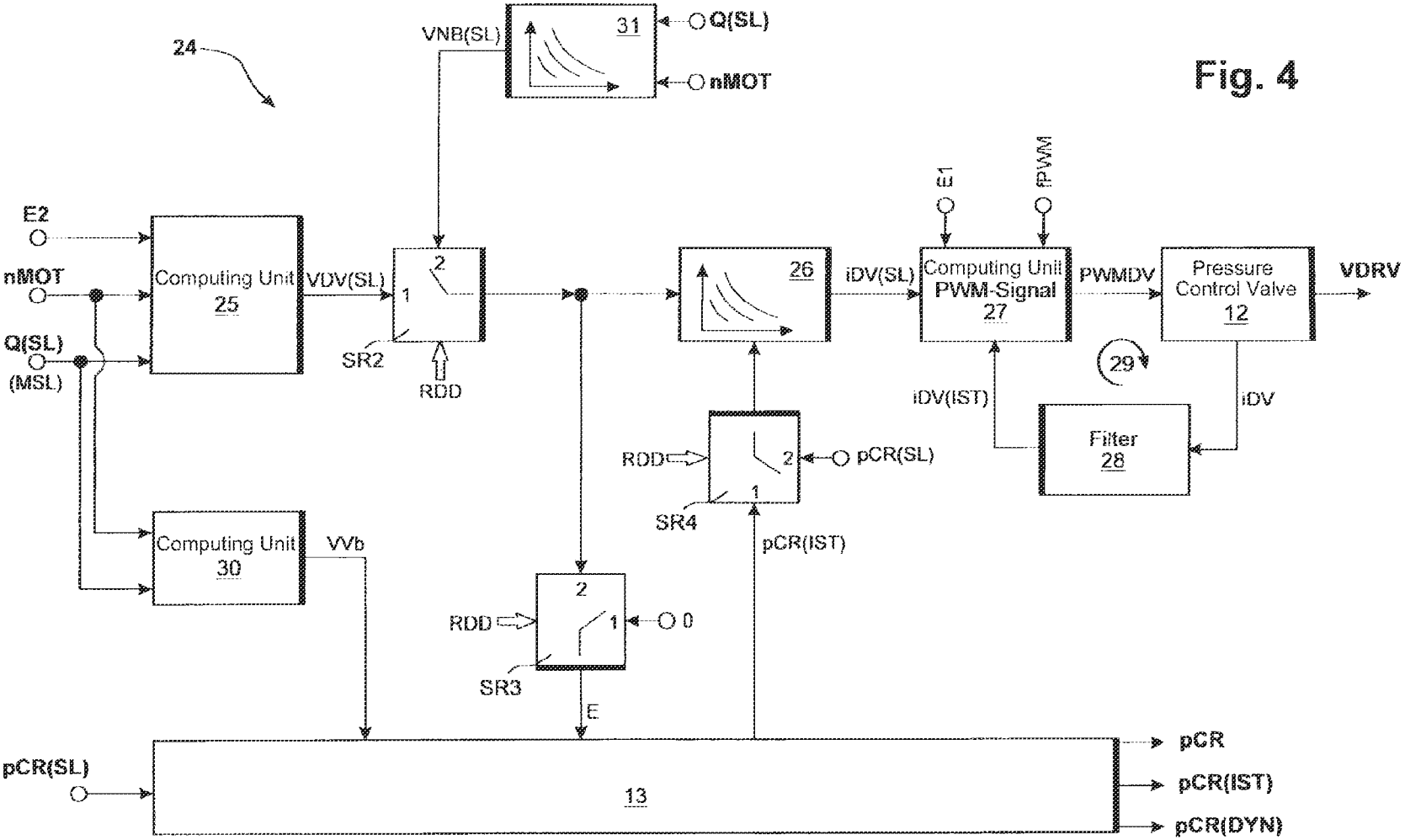
FIG. 4 is a closed-loop pressure control system with open-loop control.

The system will now be further described first for normal operation, in which the switch SR1 is in position 1, and the variable E has the value zero. The actual rail pressure pCR (IST) is computed from the raw value of the rail pressure pCR by means of a first filter 21. This value is, then compared with the set value pCR(SL) at a summation point A, and a control deviation ep is obtained from this comparison. A correcting variable is computed from the control deviation ep by a pressure controller 14. The correcting variable represents a controller volume flow VR with the physical unit of liters/minute. The computed set consumption VVb is added to the controller volume flow VR at a summation point B. The set consumption VVb is computed by a computing unit 30, which is shown in FIG. 4 and will be explained in connection with the description of FIG. 4. The result of the addition at summation point B represents a cumulative volume flow VS. At a summation point C, the variable E (here: 0 liters/minute) is added to the cumulative volume flow VS. The result of the addition at point C represents an unlimited set volume flow VSDu(SL) of the suction throttle, which is an input variable of functional block 15, which will now be explained in connection with the description of FIG. 3.

The unlimited set volume flow VSDu(SL) for the suction throttle is then limited by a limiter 16 as a function of the engine speed nMOT. The output variable of the limiter 16 is a set volume flow VSD(SL) of the suction throttle. A corresponding set electric current iSD(SL) of the suction throttle is then assigned to the set volume flow VSD(SL) by the pump characteristic curve 17. The set current iSD(SL) is converted by a computing unit 18 to a PWM signal PWMSD for activating the suction throttle. The PWM signal PWMSD represents the duty cycle, and the frequency fPWM corresponds to the base frequency. The magnetic coil of the suction throttle is then acted upon by the PWM signal PWMSD. In FIG. 3, the suction throttle and the high-pressure pump are combined in the unit 19. The displacement of the magnetic core of the suction throttle is changed by the PWM signal PWMSD, and the output of the high-pressure pump is freely controlled in this way. For safety reasons, the suction throttle is open in the absence of current and is acted upon by current via PWM activation to move in the direction of the closed position. A closed-loop current control system with the controlled variable iHD, a filter 20, and the actual quantity iHD(IST) can be subordinate to the PWM signal computing unit 18. The output variable of the functional block 15 is the actual volume flow VHDP delivered by the high-pressure pump. This volume flow (see FIG. 2) is pumped into the rail 6. The pressure level in the rail 6 is detected by the rail pressure sensor, and the actual rail pressure pCR(IST) is computed by the first filter 21, and the dynamic rail pressure pCR(DYN) is computed by a second filter 22. In this regard, the second filter 22 has a smaller time constant and smaller phase distortion than the first filter 21. The closed-loop control system is thus closed.

If a defective rail pressure sensor is now detected, correct computation of the control deviation ep and the controller volume flow VR is no longer possible. Therefore, in a first step, the signal RDD is set, which causes the switch SR1 to switch to position 2, and the controller volume flow VR is set as no longer determining. In a second step, the variable E is changed from the value zero to the value of the set emergency operation volume flow VNB(SL), which is computed by an emergency operation input-output map. The emergency operation input-output map is explained in greater detail in connection with FIG. 4. The unlimited set volume flow VSDu (SL) of the suction throttle is computed from the sum of the set consumption VVb and the variable E (here: the set emergency operation volume flow VNB(SL). As previously described, the unlimited set volume flow VSDu(SL) is converted to the triggering signal for the suction throttle by the functional block 15.

FIG. 2 shows possible supplementary means for handling a defective rail pressure sensor. In the event of a defective rail pressure sensor, the switch SR1 switches to position 3, so that the cumulative volume flow VS is now computed from the set consumption VVb and a leakage volume flow VLKG. The leakage volume flow VLKG is determined by a leakage input-output map 23 as a function of a set injection quantity Q(SL) and the engine speed nMOT. The set injection quantity Q(SL) in turn is either computed by an input-output map as a function of the power desired by the operator or corresponds to the correcting variable of a speed controller. The unlimited set volume flow VSDu(SL) for the suction throttle is then computed from the sum of the leakage volume flow VLKG, the set consumption VVb, and the set emergency operation volume flow VNB(SL). The conversion of the unlimited set volume flow VSDu(SL) to the triggering signal for the suction throttle is then carried out by the functional block 15, as described above. This supplementation by the leakage input-output map 23 offers the advantage of better system adaptation in the event of failure of the rail pressure sensor.

FIG. 4 is a block diagram showing the greatly simplified closed-loop rail pressure control system 13 (FIG. 2, FIG. 3) and an open-loop control system 24. The open-loop control system 24 serves to adjust the pressure control valve volume flow VDRV as a rail pressure disturbance variable. The input variables of the open-loop control system 24 are: the engine speed nMOT, the set injection quantity Q(SL) or a set torque MSL, the signal RDD, the variable E1 for computing the PWM signal PWMDV, and a variable E2. The variable E2 combines the set rail pressure pCR(SL), the actual rail pressure pCR(IST), and the dynamic rail pressure pCR(DYN). The set injection quantity Q(SL) is either computed by an input-output map as a function of the power desired by the operator or corresponds to the correcting variable of a speed controller. The physical unit of the set injection quantity Q(SL) is $mm^3$/stroke. In a torque-oriented structure, the set torque MSL is used instead of the set injection quantity Q(SL). The output variables of the open-loop control system 24 are the pressure control valve volume flow VDRV, the set consumption VVb, and the variable E. The set consumption VVb and the variable E are input variables of the closed-loop rail pressure control system 13.

The system will now be further described first for normal operation, in which the switches SR2, SR3, and SR4 are each in position 1. A computing unit 25 uses the engine speed nMOT, the set injection quantity Q(SL), and the variable E to compute a set volume flow VDV(SL) for the pressure control valve. The computing unit 25 combines the computation of a static volume flow (VSTAT) and a dynamic volume flow (VDYN), the addition of the two volume flows, and limitation as a function of the actual rail pressure pCR(IST). The computing unit 30 likewise uses the engine speed nmOT and the set injection quantity Q(SL) to compute the set consumption VVb, which is an input variable of the closed-loop rail pressure control system 13. The set volume flow VDV(SL) of the pressure control valve is one input variable of a pressure control valve input-output map 26. The second input variable is the actual rail pressure pCR(IST), since the switch SR4 is in position 1. A set current iDV(SL) of the pressure control valve is then computed as a function of the two input variables and converted by a PWM computing unit 27 to the duty cycle PWMDV with which the pressure control valve 12 is activated. A current controller, closed-loop current control system 29, can be subordinate to the conversion. The electric current iDV that develops at the pressure control valve 12 is converted for current control to an actual current iDV(IST) by a filter 28 and fed back to the computing unit 27 for the PWM signal. The output signal of the pressure control valve 12 corresponds to the pressure control valve volume flow VDRV, i.e., the fuel volume flow that is redirected from the rail into the fuel tank.

If a defective rail pressure sensor is now detected, the signal RDD is set, which causes the switches SR2, SR3, and SR4 to switch to position 2. In position 2 of the switch SR2, the set emergency operation volume flow VNB(SL) is one input variable of the pressure control valve input-output map 26. The set emergency operation volume flow VNB(SL) is computed by an emergency operation input-output map 31 as a function of the set injection quantity Q(SL) and the engine speed nMOT. The emergency operation input-output map 31 is realized in such a form that in the entire operating range of the internal combustion engine, a pressure control valve volume flow VDRV greater than zero (VDRV>0 liters/minute) is redirected from the rail into the fuel tank. The operating range of the internal combustion engine is understood to mean the speed range between the starting speed (idle speed) and the cutoff speed or between an idle torque and the maximum torque. The set emergency operation volume flow VNB(SL) is now also an input variable of the closed-loop rail pressure control system 13, since the switch SR3 occupies position 3, and thus the variable E is equal to the set emergency operation volume flow VNB(SL) (E=VNB(SL)). In other words, in the case of a defective rail pressure sensor, the set emergency operation volume flow VNB(SL) is the setpoint value for the pressure control valve 12 on the high-pressure side as well as for the suction throttle on the low-pressure side in the closed-loop rail pressure control system 13. The second input variable of the pressure control valve input-output map 26 is now the set rail pressure pCR(SL), since the switch SR4 occupies position 2. Therefore, the set current iDV(SL) for the pressure control valve is computed by the pressure control valve input-output map 26 as a function of the set rail pressure pCR(SL) and the set emergency operation volume flow VNB(SL). The conversion to the pressure control valve volume flow VDRV is then carried out as previously described.

If the high-pressure pump is pumping at the upper tolerance limit, then in emergency operating mode the rail pressure initially rises. The set high pressure pCR(SL) is one of the two input variables of the pressure control valve input-output map 26 in emergency operating mode. If the actual rail pressure pCR(IST) now rises above the set rail pressure pCR (SL), a set current iDV(SL) that is too high is now computed. Consequently, the actual redirected volume flow VDRV is greater than the set emergency operation volume flow VNB (SL). The closed-loop rail pressure control system is thus allowed a smaller volume flow that is actually redirected by the pressure control valve. The pressure rise in the rail is counteracted in this way.

Figure 5:
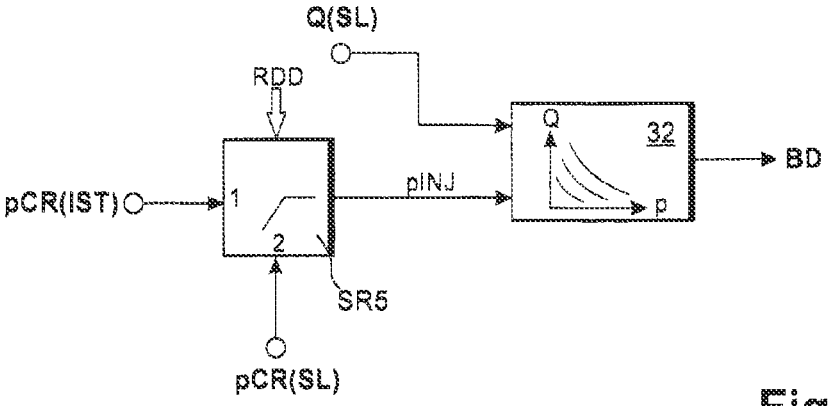
FIG. 5 is an injector input-output map.

FIG. 5 shows an injector input-output map 32, by which the energization time of an injector is computed. The input variables are the set rail pressure pCR(SL), the actual rail pressure pCR(IST), the signal RDD, and the set injection quantity Q(SL). The output variable is the energization time BD. During normal operation, the switch SR5 is in position 1, i.e., the pressure pINJ is identical with the actual rail pressure pCR (IST). The injector input-output map 32 then computes the energization time BD as a function of the pressure pINJ, i.e., the actual rail pressure pCR(IST), and the set injection quantity Q(SL). If the rail pressure sensor fails, then the signal RDD is set, which causes the switch SR5 to switch to position 2. The energization time BD is now computed as a function of the set injection quantity Q(SL) and the set rail pressure pCR(SL). If the actual rail pressure pCR(IST) swings down to a lower pressure level after failure of the rail pressure sensor, too little fuel is injected. This causes the speed of the internal combustion engine to drop. With automatic speed control of the internal combustion engine, the speed controller will then compute a larger set injection quantity Q(SL) as a correcting variable in order to maintain the speed at the set speed.

Figure 6:
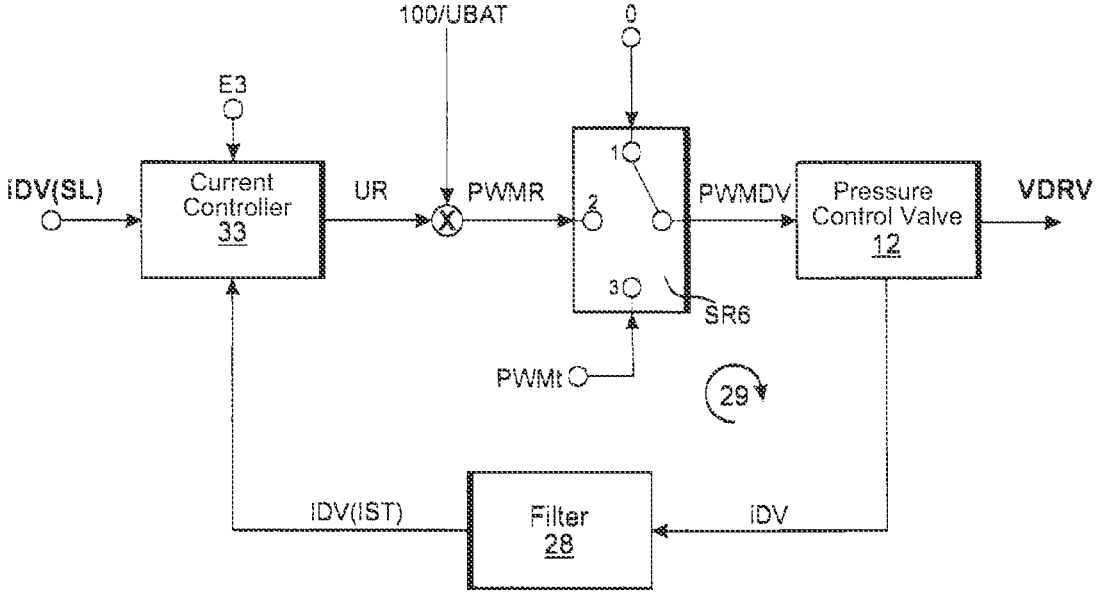
FIG. 6 is a closed-loop current control system.

FIG. 6 shows the closed-loop current control system 29 from FIG. 4. The input variables are the set current iDV(SL) of the pressure control valve, a variable E3, a quotient 100/UBAT, and a temporary PWM signal PWMt. The output variable is the pressure control valve volume flow VDRV. The closed-loop current control system 29 consists of a current controller 33, a switch SR6, the pressure control valve 12 as the controlled system, and the filter 28 in the feedback path. The current controller 33 outputs a controller voltage UR as a correcting variable, which is multiplied by the quotient 100/UBAT to obtain the PWM signal PWMR. This is the input variable of the switch SR6. The other two input signals of the switch SR6 are the value zero and the temporary PWM signal PWMt. The temporary PWM signal PWMt is realized in such a form that an increased PWM value, for example 80%, is output for a timed interval. Different functional states are represented by means of the switch SR6. If the switch is in the position SR6=1, a shutdown mode is set. In the position SR6=2, an operating mode is set, and in position SR6=3, a protective mode is set. The protective mode is set when the dynamic rail pressure pCR(DYN) rises above a maximum value. The output signal of the switch SR6 is the PWM signal PWMDV, with which the pressure control valve 12 is activated. The electric current iDV that develops at the pressure control valve 12 is measured, and the filter 28 computes the actual current iDV(IST), which is then fed back to the current controller 33. The closed-loop current control system 29 is thus closed.

Figure 7:
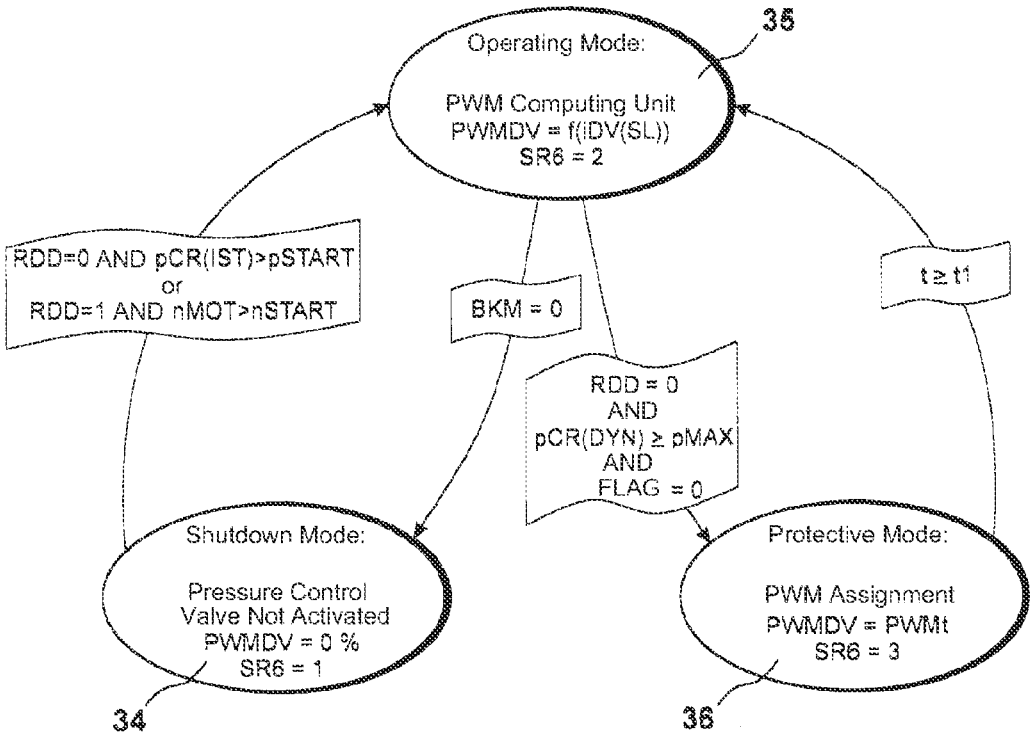
FIG. 7 is a diagram of the functional modes.

FIG. 7 shows a state diagram for the different modes and the corresponding transitions. Reference number 34 designates the shutdown mode, reference number 35 the operating mode, and reference number 36 the protective mode. The shutdown mode 34 is set when an engine shutdown is detected. When shutdown mode 34 is set, the pressure control valve (DRV) is not activated, since the switch SR6 (FIG. 6) is in position 1 and therefore a PWM value of zero is output. Accordingly, PWMDV=0%.

When the rail pressure sensor is operating correctly (RDD=0), a change is made from shutdown mode 34 to operating mode 35 if the actual rail pressure pCR(IST) rises above an initial value pSTART, for example, pSTART=800 bars, a verified engine speed nMOT is detected, and the rail pressure sensor is not defective (RDD=0). In the transition, the switch SR6 (FIG. 6) moves into position 2, in which the PWM signal PWMDV for controlling the pressure control valve is computed as a function of the set current iDV(SL). When the rail pressure sensor is operating correctly, the set current iDV(SL) of the pressure control valve is computed as a function of the actual rail pressure pCR(IST) and the set volume flow VDV(SL) by the pressure control valve input-output map. A change back to shutdown mode 34 occurs if an engine shutdown is detected (BKM=0). If, while normal mode 35 is set, it is detected that the dynamic rail pressure pCR(DYN) exceeds a maximum pressure value pMAX, an interrogation is carried out to determine whether, first, the protective mode 36 has been enabled and, second, whether the rail pressure sensor is operating correctly. The test to determine whether the protective mode has been enabled occurs by means of a flag. Swinging back and forth between normal mode and protective is prevented by the flag. During the change to protective mode 36, the switch SR6 is switched over to the position SR6=3. In this position, the PWM signal PWMDV is temporarily set to a maximum value, for example, PWMt=80%. Accordingly, PWMDV=PWMt. This time function can also be realized as a timed step function with different values, for example, value 1 PWMt=80% and value 2 PWMt=60%. If a time interval t1 has elapsed, then the protective mode 36 is terminated and the normal mode 35 is set again. The switch SR6 changes back to position 2 (SR6=2). The protective mode 36 is not enabled again until the dynamic rail pressure pCR(DYN) falls below the maximum pressure value pMAX by a hysteresis value.

If a defective rail pressure sensor is detected, the actual rail pressure pCR(IST) can no longer be sensed. In this case, a change is made from shutdown mode 34 to operating mode 35 only if the engine speed nMOT rises above a starting speed nSTART. When the operating mode 35 is set, the switch SR6 (FIG. 6) is in position 2, in which the PWM signal PWMDV for activating the pressure control valve is computed as a function of the set current iDV(SL) of the pressure control valve. However, the set current iDV(SL) is now computed as a function of the set rail pressure pCR(SL) and the set emergency operation volume flow VNB(SL). At the same time, the set emergency operation volume flow VNB(SL) is set as the setpoint value for the suction throttle on the low-pressure side in the closed-loop rail pressure control system. The change back to the shutdown mode 34 occurs if an engine shutdown is detected (BKM=0). When the operating mode 35 is set, a change to protective mode is prevented, since correct operation of the rail pressure sensor must be present.

FIG. 8 is a time chart that shows the behavior of the closed-loop high-pressure control system in the event of failure of the rail pressure sensor. FIG. 8 comprises four separate graphs 8A to 8D, which show the following as a function of time: the signal RDD in FIG. 8A, a volume flow V of the pressure control valve in FIG. 8B, the rail pressure pCR in FIG. 8C, and the volume flow VHDP delivered by the high-pressure pump in FIG. 8D. In FIG. 8B, the set emergency operation volume flow VNB(SL) is plotted as a solid line, and the actual pressure control valve volume flow VDRV redirected by the pressure control valve is plotted as a broken line. In FIG. 8C, the set rail pressure pCR(SL) is plotted as a solid line, and the actual rail pressure pCR(IST) is plotted as a broken line. In FIG. 8D, the set consumption VVb is additionally graphed as a broken line. In the specific example shown here, the following conditions are assumed: the high-pressure pump that is used has a smaller pumping capacity than a comparison pump that is characterized by the pump characteristic, and in the event of failure of the rail pressure sensor, the controller volume flow computed by the pressure controller is set to a value of zero liters/minute, i.e., the switch SR1 in FIG. 2 is in position 2.

Figure 8A:
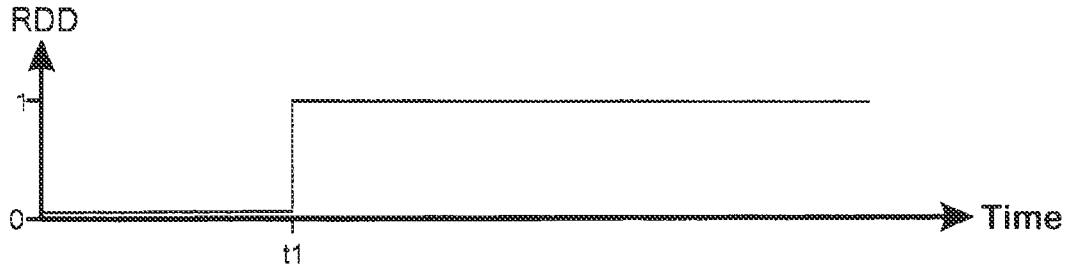
FIG. 8 is a time chart.
Figure 8B:
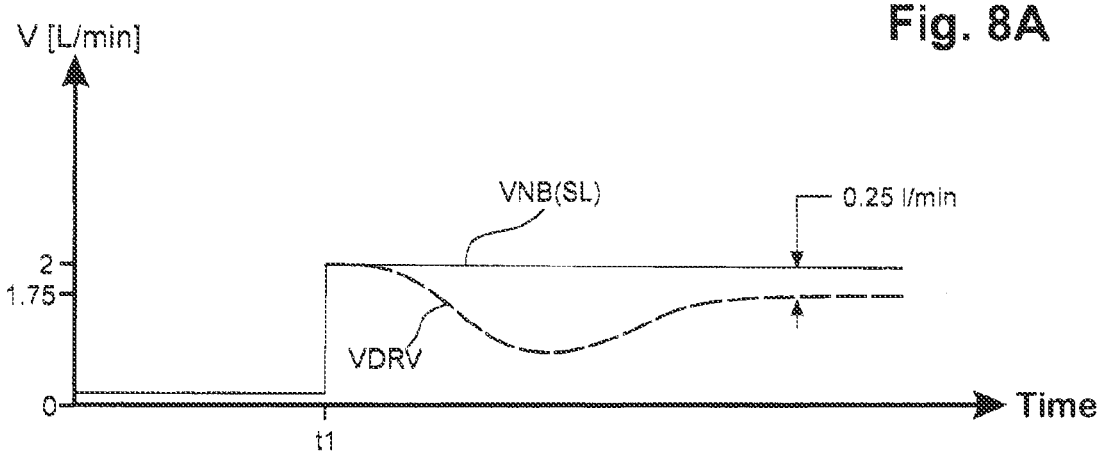
Figure 8C:
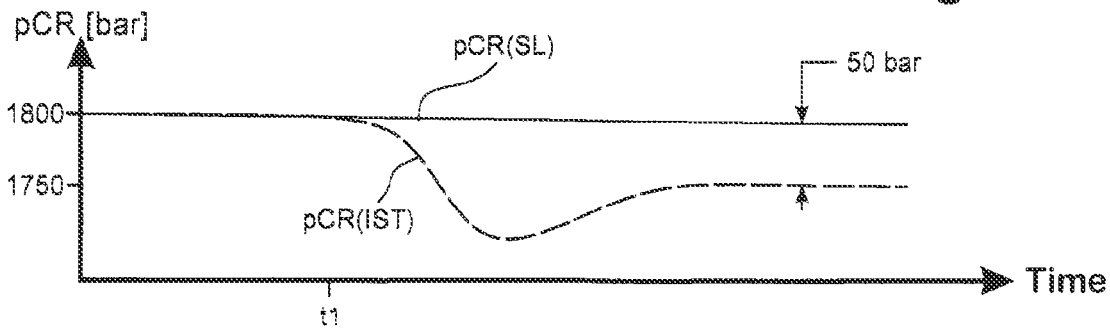
Figure 8D:
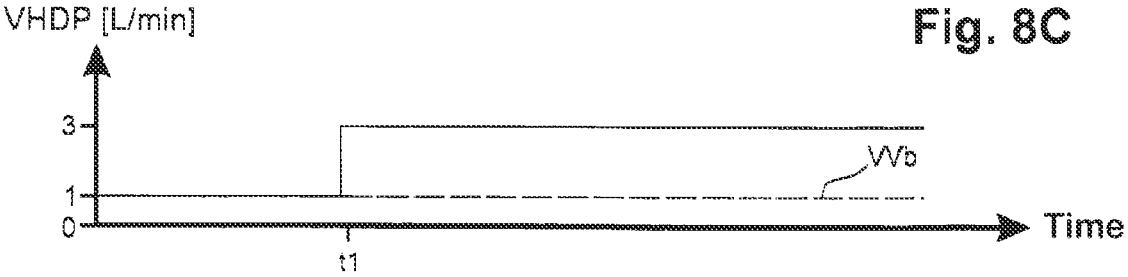

Before time t1, there is no rail pressure control deviation. Therefore, the actual rail pressure pCR(IST) corresponds to the set rail pressure pCR(SL) (see FIG. 8C). Since there is no control deviation, the high-pressure pump delivers only the set consumption of VVb=1 liter/minute (see FIG. 8D). At time t1 a defect arises in the rail pressure sensor, i.e., in FIG. 8A, the signal RDD is therefore set to a value of one, and a change is made to emergency operation by the switches SR2, SR3 and SR4 changing to position 2. The set emergency operation volume flow VNB(SL) is now set as the setpoint value for the pressure control valve. The set emergency operation volume flow VNB(SL) is computed by the emergency operation input-output map. In the present example, a set emergency operation volume flow of VNB(SL)=2 liters/minute is redirected by means of the emergency operation input-output map (FIG. 8B). Since the high-pressure pump is delivering too little fuel, the actual rail pressure pCR(IST) initially drops in FIG. 8C. This has the consequence that the pressure control valve volume flow VDRV redirected by the pressure control valve actually becomes smaller than the set emergency operation volume flow VNB(SL), because, after the failure of the rail pressure sensor, the pressure control valve input-output map (FIG. 4: 26) has the set rail pressure pCR(SL) as input variable, and this is now greater than the actual rail pressure pCR(IST). After an oscillation process, the actual rail pressure pCR(IST) and the pressure control valve volume flow VDRV swing in to a new level that is lower than the corresponding set values. Since with the failure of the rail pressure sensor at time t1, the set emergency operation volume flow VNB(SL) also becomes the input variable for the closed-loop rail pressure control system, the volume flow pumped by the high-pressure pump VHDP increases by the amount of the set emergency operation volume flow VNB (SL), here: 2 liters/minute. In FIG. 8D, therefore, the volume flow VHDP increases to a value of VHDP=3 liters/minute. In the steady state, the pressure control valve volume flow VDRV is smaller than the set emergency operation volume flow VNB(SL) by 0.25 liters/minute. A pressure level develops for the actual rail pressure pCR(IST) that is 50 bars less than the set rail pressure pCR(SL) (see FIG. 8C).

Figure 9:
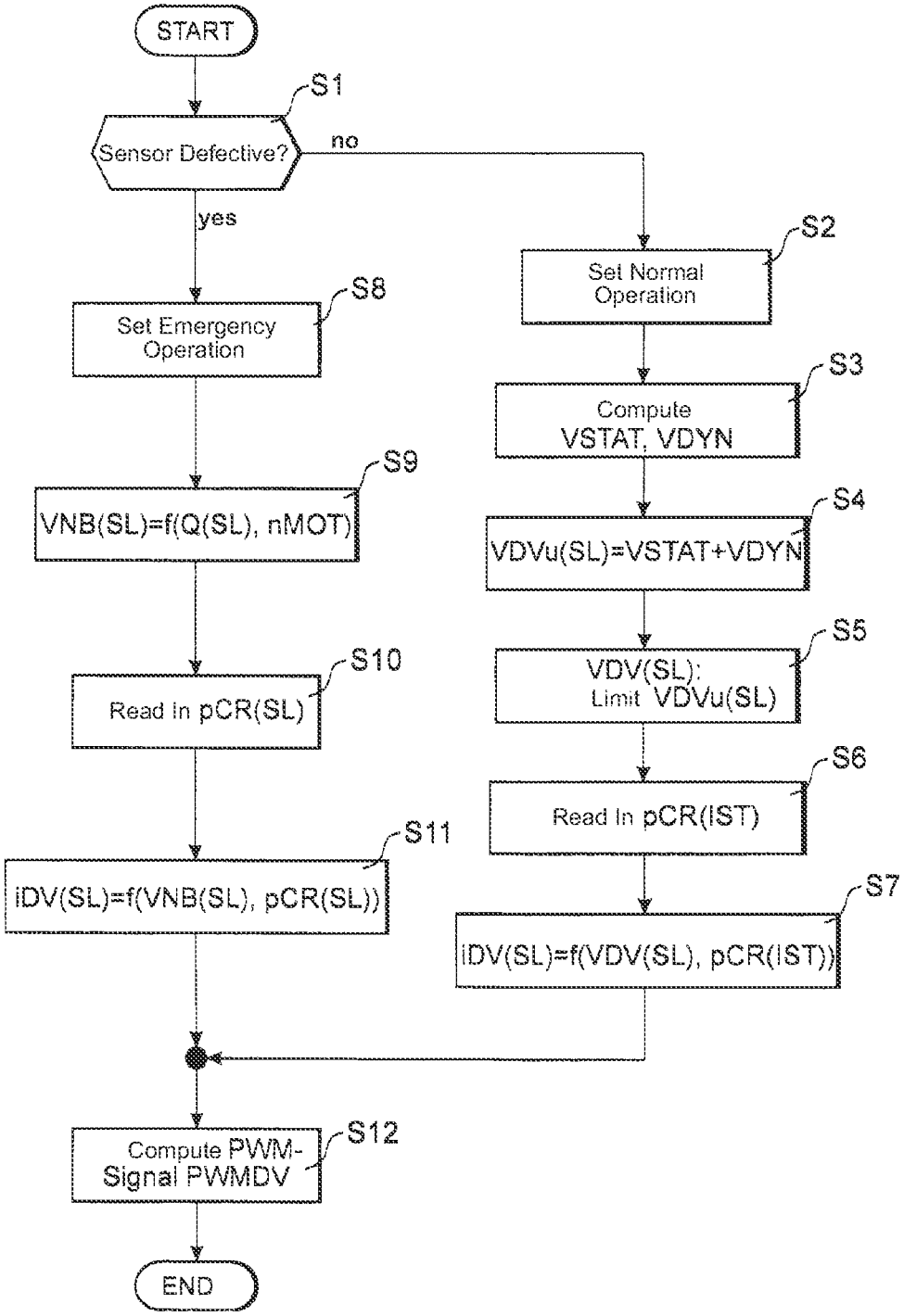
FIG. 9 is a program flowchart (pressure control valve).

FIG. 9 is a program flowchart for computing the PWM signal PWMDV of the pressure control valve. At S1 a check is made to determine whether a defective rail pressure sensor is present. If this is not the case (interrogation result S1: no), control passes to routine S2 to S7. In the event of a defective rail pressure sensor, control passes to routine S8 to S11. If a correctly operating rail pressure sensor was determined at S1, then normal operating mode is set at S2 by setting switches SR2 to SR4 to position 1. After transition from shutdown mode to operating mode, switch SR6 is additionally switched to position 2, i.e., the PWM signal PWMDV is computed. At S3 a static volume flow VSTAT is computed as a function of the set injection quantity and the engine speed, and a dynamic volume flow VDYN is computed as a function of the set rail pressure and the actual rail pressure or the dynamic rail pressure. These volume flows are then added at S4. The result corresponds to an unlimited set volume flow VDVu(SL). At S5 this is limited as a function of the actual rail pressure pCR(IST) and is set as the set volume flow VDV(SL). The steps S3 to S5 are carried out in the computing unit 25 (see FIG. 4). At S6 a new value of the actual rail pressure pCR (IST) is read in. Then at S7 the pressure control valve input-output map uses the actual rail pressure pCR(IST) and the set volume flow VDV(SL) of the pressure control valve to compute the set current iDV(SL). At S12 the PWM signal PWMDV is then computed as a function of the set current iDV(SL). This ends the program flowchart in normal operation.

If a defective rail pressure sensor was detected at S1 (interrogation result S1: yes), correct control of the pressure control valve is no longer possible. Therefore, at S8 emergency operating mode is set by switching the switches SR2, SR3, and SR4 to position 2. The emergency operation input-output map is now determining. At S9 the set emergency operation volume flow VNB(SL) is computed by the emergency operation input-output map as a function of the set injection quantity Q(SL) and the engine speed nMOT. Then at S10 the set rail pressure pCR(SL) is read in, and at S11 the set current iDV(SL) is computed by the pressure control valve input-output map as a function of the set rail pressure pCR(SL) and the set emergency operation volume flow VNB(SL). At S12 the PWM signal PWMDV for activating the pressure control valve is then computed as a function of the set current iDV (SL). This ends the program flowchart in emergency operation.

Figure 10:
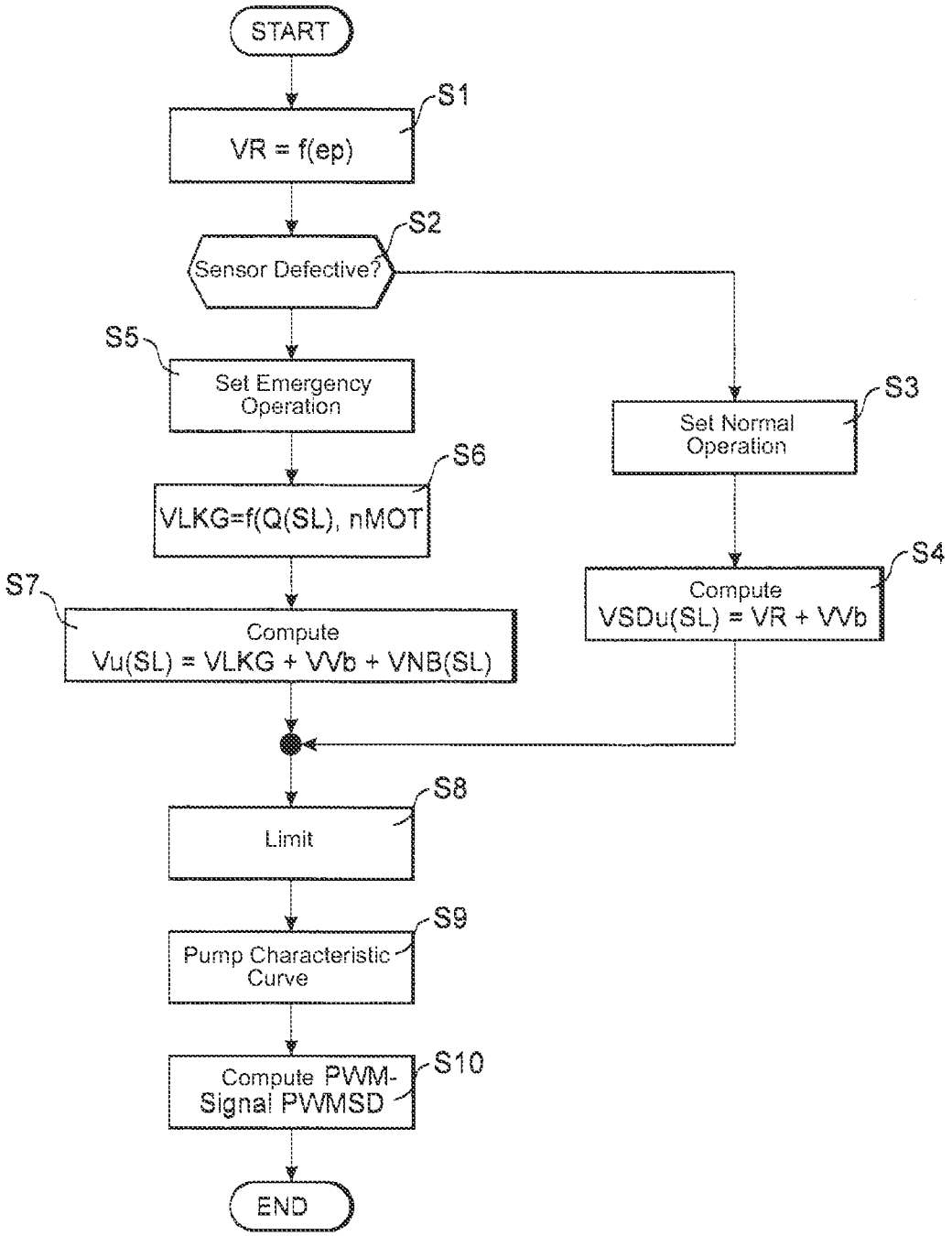
FIG. 10 is a program flowchart (suction throttle).

FIG. 10 is a program flowchart for computing the PWM signal PWMSD of the suction throttle. The program flow was based on the embodiment in which a leakage volume flow is computed in the emergency operation. At S1 the control deviation ep is used to compute the controller volume flow VR as a correcting variable of the pressure controller. The control deviation ep is determined as the difference between the set rail pressure pCR(SL) and the actual rail pressure pCR(IST). Then at S2 a check is made to determine whether the rail pressure sensor is defective. If this is not the case (interrogation result S2: no), then control passes to the routine comprising S3 and S4. Otherwise, control passes to the routine S5 to S7.

If it was determined at S2 that the rail pressure sensor is functioning correctly, then at S3 the normal operating mode is set, and at S4 the unlimited set volume flow VSDu(SL) for the suction throttle is computed from the sum of the controller volume flow VR and the set consumption VVb. Then at S8 the unlimited set volume flow VSDu(SL) is limited as a function of the engine speed. The result corresponds to the set volume flow VSD(SL), to which a set current iSD(SL) is assigned at S9 by the pump characteristic curve. The set current iSD(SL) in turn is used to compute the PWM signal PWMSD at S10. This ends the program flowchart for normal operation.

If, on the other hand, a defective rail pressure sensor was detected at S2, the mode is changed to emergency operating mode at S5. In emergency operation, at S6 the leakage volume flow VLKG is first computed as a function of the set injection quantity Q(SL) and the engine speed nMOT. At S7 the unlimited set volume flow VSDu(SL) of the suction throttle is computed from the sum of the leakage volume flow VLKG, the set consumption VVb, and the set emergency operation volume flow VNB(SL). Then at S8 the unlimited set volume flow VSDu(SL) is limited as a function of the engine speed. The result corresponds to the set volume flow VSD(SL), to which a set current iSD(SL) is assigned by the pump characteristic curve at S9. The set current iSD(SL) in turn is used to compute the PWM signal PWMSD at S10. This ends the program flowchart for the emergency operation.

LIST OF REFERENCE NUMBERS

1 internal combustion engine
2 fuel tank
3 low-pressure pump
4 suction throttle

5 high-pressure pump
6 rail
7 injector
8 individual accumulator (optional)
9 rail pressure sensor
10 electronic control unit (ECU)
11 pressure control valve, passive
12 pressure control valve, electrically controllable
13 closed-loop rail pressure control system
14 pressure controller
15 functional block
16 limiter
17 pump characteristic curve
18 computing unit for PWM signal
19 unit (suction throttle and high-pressure pump)
20 filter (current)
21 first filter
22 second filter
23 leakage input-output map
24 open-loop control system
25 computing unit (pressure control valve set volume flow)
26 pressure control valve input-output map
27 computing unit for the PWM signal
28 filter
29 closed-loop current control system (pressure control valve)
30 computing unit (set consumption)
31 emergency operation input-output map
32 injector input-output map
33 current controller
34 shutdown mode
35 operating mode
36 protective mode

The invention claimed is:

1. A method for open-loop and closed-loop control of an internal combustion engine, comprising the steps of: automatically controlling a rail pressure during normal operation in a closed-loop rail pressure control system by a suction throttle on a low-pressure side of the closed-loop rail pressure control system, which suction throttle acts as a first pressure regulator, and, simultaneously, the rail pressure is acted upon with a rail pressure disturbance variable of a pressure control valve on a high-pressure side of the closed-loop rail pressure control system, in which pressure control valve acts as a second pressure regulator by a pressure control valve volume flow being redirected from a rail into a fuel tank by the pressure control valve on the high-pressure side; and, if a defective rail pressure sensor is detected, changing to an emergency operating mode, in which the pressure control valve on the high-pressure side is actively actuated and the suction throttle on the low-pressure side is actuated as a function of a common set point value, wherein the common setpoint value corresponds to a set emergency operation volume flow, which is computed by an emergency operation input-output map as a function of a set injection quantity and engine speed, the method further including, in the emergency operating mode, computing a PWM signal for activating the pressure control valve as a function of the set emergency operation volume flow and a set rail pressure, wherein a leakage volume flow is superimposed on the set emergency operation volume flow as a correction variable of the closed-loop rail pressure control system.

2. The method in accordance with claim 1, wherein the emergency operation input-output map is realized so that in an entire operating range of the internal combustion engine the pressure control valve volume flow is redirected from the rail into the fuel tank.

3. The method in accordance with claim 1, including, during normal operation, setting a protective mode for temporarily increasing the PWM signal of the pressure control valve if the rail pressure rises above a limit, and blocking the protective mode in the emergency operating mode.

4. The method in accordance with claim 3, including, when a protective mode is set, preventing resetting the protective mode if, with the protective mode set, a defective rail pressure sensor is detected and a switch is made to emergency operating mode.

5. The method in accordance with claim 1, including, in the emergency operation, adding a set consumption to the set emergency operation volume flow as a correcting variable of the closed-loop rail pressure control system.

6. The method in accordance with claim 5, including optionally additionally adding a leakage volume flow, which is computed by a leakage input-output map as a function of the set injection quantity and the engine speed.

7. The method in accordance with claim 1, further including, in a speed-based structure, computing the set injection quantity by a speed controller as a correcting variable.

8. The method in accordance with claim 1, wherein in a torque-based structure, the set injection quantity corresponds to a set torque.

* * * * *